US010455929B2

(12) United States Patent
Corbett et al.

(10) Patent No.: US 10,455,929 B2
(45) Date of Patent: Oct. 29, 2019

(54) TOOTHBRUSH WITH ANGLED BRISTLES

(71) Applicant: Dr. Fresh, LLC, Buena Park, CA (US)

(72) Inventors: Doug Corbett, New Canaan, CT (US); Geoff Carroll, Los Angeles, CA (US); Huy Kha Nguyen, Anaheim, CA (US)

(73) Assignee: Dr. Fresh, LLC, La Palma, CA (US)

( * ) Notice: Subject to any disclaimer, the term of this patent is extended or adjusted under 35 U.S.C. 154(b) by 214 days.

(21) Appl. No.: 15/342,021

(22) Filed: Nov. 2, 2016

(65) Prior Publication Data

US 2017/0071324 A1 Mar. 16, 2017

Related U.S. Application Data

(63) Continuation of application No. 15/246,217, filed on Aug. 24, 2016, now Pat. No. 9,609,940, which is a continuation of application No. 14/490,550, filed on Sep. 18, 2014, now Pat. No. 9,456,880.

(60) Provisional application No. 61/879,615, filed on Sep. 18, 2013, provisional application No. 61/934,616, filed on Jan. 31, 2014.

(51) Int. Cl.

| | |
|---|---|
| ***A46B 5/02*** | (2006.01) |
| ***A46B 9/04*** | (2006.01) |
| ***A46B 9/02*** | (2006.01) |
| ***A46B 9/06*** | (2006.01) |
| ***A46B 15/00*** | (2006.01) |

(52) U.S. Cl.

CPC ..... *A46B 9/04* (2013.01); *A46B 5/021* (2013.01); *A46B 5/026* (2013.01); *A46B 9/025* (2013.01); *A46B 9/06* (2013.01); *A46B 15/0081* (2013.01); *A46B 2200/1066* (2013.01)

(58) Field of Classification Search

CPC ..... A46B 9/04; A46B 5/021; A46B 5/026

See application file for complete search history.

(56) References Cited

U.S. PATENT DOCUMENTS

| | | | |
|---|---|---|---|
| 3,229,318 | A | 1/1966 | Clemens |
| 4,010,509 | A | 3/1977 | Huish |
| 4,706,322 | A | 11/1987 | Nicolas |
| 5,046,213 | A | 9/1991 | Curtis et al. |
| D342,162 | S | 12/1993 | Curtis |
| 5,341,537 | A | 8/1994 | Curtis |

(Continued)

FOREIGN PATENT DOCUMENTS

| | | |
|---|---|---|
| EP | 0885573 | 12/1998 |
| WO | WO 2012/177841 | 12/2012 |

*Primary Examiner* — Randall E Chin

(74) *Attorney, Agent, or Firm* — Kane Kessler, P.C.; Paul E. Szabo

(57) ABSTRACT

A toothbrush having a distal end and a proximal end. The toothbrush has a head portion located at the distal end. The toothbrush also has a plurality of bristles coupled to the head portion and extending outward in a ventral direction. The toothbrush also has a neck portion being coupled to the head portion at a neck portion distal end. The toothbrush also has a shoulder portion being coupled to the neck portion at a shoulder portion distal end and a neck portion proximal end, and the shoulder portion being curved toward the ventral direction. The toothbrush also has a base portion located at the proximal end, the base portion being coupled to the shoulder portion at a base portion distal end and a shoulder portion proximal end, the base portion being curved toward the ventral direction.

3 Claims, 17 Drawing Sheets

(56) References Cited

U.S. PATENT DOCUMENTS

| | | | | |
|---|---|---|---|---|
| D464,799 | S | 10/2002 | Crossman | |
| 6,957,469 | B2 | 10/2005 | Davies | |
| 8,185,993 | B2 | 5/2012 | Fischer | |
| 8,239,996 | B2 | 8/2012 | Garbers | |
| 8,813,299 | B2 | 8/2014 | Gabers | |
| 9,095,205 | B2 | 8/2015 | Stofko | |
| 2002/0056197 | A1 | 5/2002 | Johnson | |
| 2007/0204417 | A1* | 9/2007 | Russell | A46B 5/0029 15/167.1 |
| 2007/0283518 | A1 | 12/2007 | Blanchard et al. | |
| 2008/0201886 | A1 | 8/2008 | Biefeldt et al. | |
| 2010/0101038 | A1 | 4/2010 | Garbers et al. | |
| 2011/0146015 | A1* | 6/2011 | Moskovich | A46B 5/02 15/167.1 |

* cited by examiner

TOOTHBRUSH WITH ANGLED BRISTLES

CROSS REFERENCE TO RELATED APPLICATIONS

This application is a continuation of U.S. patent application Ser. No. 15/246,217 entitled "Toothbrush with Angled Bristles," filed Aug. 24, 2016, U.S. Pat. No. 9,609,940, which is a continuation of U.S. patent application Ser. No. 14/490,550 entitled "Toothbrush with Angled Bristles," filed on Sep. 18, 2014, U.S. Pat. No. 9,456,680, which claims the benefit and priority of U.S. Provisional Application No. 61/879,615, filed on Sep. 18, 2013, entitled "Toothbrush with Angled Bristles" and U.S. Provisional Application No. 61/934,616, filed on Jan. 31, 2014, entitled "Toothbrush with Angled Bristles," the contents of each of which are herein incorporated by reference in their entirety.

BACKGROUND

1. Field of the Invention

The present invention relates to dental hygiene, and more particularly to a toothbrush with angled bristles for better and more effective teeth cleaning.

2. Description of the Related Art

To ensure proper oral care, dentists recommend that we brush our teeth more than once a day for at least two to three minutes each time. Despite this recommendation, the average adult person does not brush his or her teeth for two to three minutes. Therefore, toothbrushes that provide better and more effective teeth cleaning can be beneficial to adults who don't have the requisite time to brush their teeth. Also, even if the proper amount of time is used to brush, a toothbrush with a better arrangement of bristles can provide more effective teeth cleaning. Accordingly, there is a need for a toothbrush that provides advanced and superior cleaning for more effective teeth cleaning and better dental hygiene.

SUMMARY OF THE INVENTION

According to some embodiments, a toothbrush having a distal end and a proximal end. The toothbrush has a head portion located at the distal end. The toothbrush also has a plurality of bristles coupled to the head portion and extending outward in a ventral direction. The toothbrush also has a neck portion having a neck portion distal end and a neck portion proximal end, the neck portion being coupled to the head portion at the neck portion distal end. The toothbrush also has a shoulder portion having a shoulder portion distal end and a shoulder portion proximal end, the shoulder portion being coupled to the neck portion at the shoulder portion distal end and the neck portion proximal end, and the shoulder portion being curved toward the ventral direction. The toothbrush also has a base portion located at the proximal end, the base portion having a base portion distal end and a base portion proximal end, the base portion being coupled to the shoulder portion at the base portion distal end and the shoulder portion proximal end, the base portion being curved toward the ventral direction.

According to some embodiments, a toothbrush having a top end, a bottom end, a front, and a back. The toothbrush has a head portion located at the top end including bristles extending outward from the head portion on the front. The toothbrush also has a handle portion. The handle portion has a neck portion having a neck portion top end and a neck portion bottom end. The handle portion also has a shoulder portion having a shoulder portion top end and a shoulder portion bottom end and being curved toward the front. The handle portion also has a base portion having a base portion top end and a base portion bottom end and being curved toward the front, the head portion connected to the neck portion top end, the neck portion bottom end connected to the shoulder portion top end, and the shoulder portion bottom end connected to the base portion top end.

BRIEF DESCRIPTION OF THE DRAWINGS

The features and advantages of the embodiments of the present disclosure will become more apparent from the detailed description set forth below when taken in conjunction with the drawings. Naturally, the drawings and their associated descriptions illustrate example arrangements within the scope of the claims and do not limit the scope of the claims. Reference numbers are reused throughout the drawings to indicate correspondence between referenced elements.

DETAILED DESCRIPTION

In the following detailed description, numerous specific details are set forth to provide an understanding of the present disclosure. It will be apparent, however, to one of ordinarily skilled in the art that elements of the present disclosure may be practiced without some of these specific details. In other instances, well-known structures and techniques have not been shown in detail to avoid unnecessarily obscuring the present disclosure.

Figure 1:
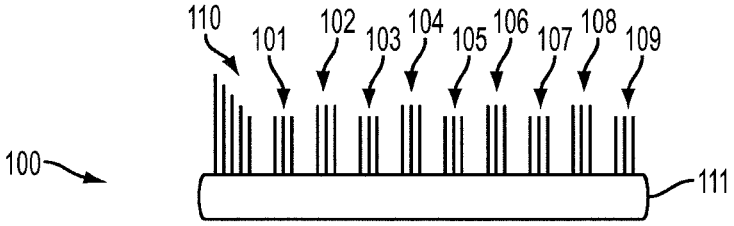
FIG. 1 is a side view of a head of a toothbrush according to an embodiment of the invention.

FIG. 1 is a side view of a head 111 of a toothbrush 100 according to an embodiment of the invention. For illustrative purposes, only a portion of the toothbrush 100 is shown. The toothbrush 100 includes a head 111 and a plurality of bristles 101-110 attached to the head 111. The head 111 can be made of a hard plastic material. The bristles 101-110 may be fastened by anchors or anchor wires into blind ended holes. Alternatively, anchor free or hot tufting methods are used to fasten the bristles 101-110 to the head 111.

An anchor free bristle design or anchor free technology provides superior capabilities when compared to other known bristle fastening techniques. For example, anchor free technology provides better securement between the bristles and the head of the toothbrush and allows for additional capabilities such as angled bristles and tapered bristles. Also, anchor free technology allows for large round tufts to be positioned in rows and columns where each tuft has a relatively constant horizontal cross section.

In one embodiment, the toothbrush 100 utilizes staple technology to attach the plurality of bristles 101-110 to the head 111. The staple technology allows for the bristles to accurately provide the three angled arrangement and configuration of the plurality of bristles 101-111.

Figure 2:
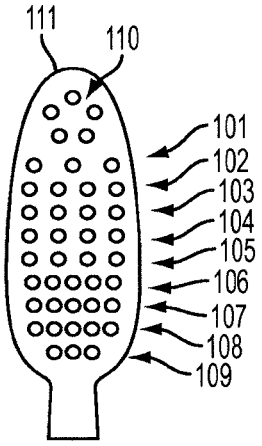
FIG. 2 is a top view of the head illustrating a plurality of bristle tufts according to an embodiment of the invention.

FIG. 2 is a top view of the head 111 illustrating a plurality of bristle tufts according to an embodiment of the invention. Individual bristle filaments are grouped together to form bristle bundles or bristle tufts which are arranged in a predefined geometry onto the head 111. That is, a bristle tuft includes a plurality of bristles. For illustrative purposes, each circle shown in FIG. 2 represents a bristle tuft. The plurality of bristle tufts 101-109 are arranged and/or angled to provide better and more effective teeth cleaning. The top set of bristle tufts 110 includes 5 bristle tufts that are arranged in a circular configuration. The top set of bristle tufts 110 are generally referred to as a toe tuft. As shown in FIG. 1, the bristle tufts 110 are arranged at a downward angle where the front most bristle tufts have a higher height than the back most bristle tufts. As an example, each bristle tuft may be arranged in the shape of a circle, a rectangle, a square, an elliptical or an oval. The top set of bristle tufts 110 being arranged in a circular configuration and arranged at a downward angle improves teeth and gum cleaning in hard to reach areas and locations between and around the teeth and gums.

Figure 3:
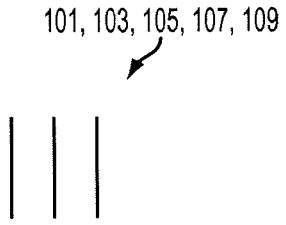
FIG. 3 is a side view of 3 bristles tufts arranged in a vertical position according to an embodiment of the invention.

The bristle tufts 101-109 are all arranged in a row pattern. For example, the set of bristle tufts 101 includes 3 bristle tufts that are arranged along a row. Similarly, the set of bristle tufts 102 include 4 bristle tufts that are arranged along a row that is parallel to the adjacent rows. As shown in FIG. 3, the bristles tufts 101 are arranged in an upward vertical position that is perpendicular to a horizontal plane defined by the head 111. Similarly, the bristle tufts 103, 105, 107 and 109 are arranged in an upward vertical position that is perpendicular to a horizontal plane defined by the head 111. Therefore, every alternate or odd row is arranged in an upward vertical position. In one embodiment, every even row can be arranged in an upward vertical position. The number of bristle tufts per each row can vary and depends on the size of the head 111. As an example, the bristle tufts 101 and 109 each include 3 bristle tufts, the bristle tufts 103 and 105 each include 4 bristle tufts and the bristle tuft 107 includes 5 bristle tufts. As shown in FIG. 1, the bristle tufts 101, 103, 105, 107 and 109 each have a similar height and each have a height that is lower than the height of the bristle tufts 102, 104, 106 and 108. The bristle tufts 102, 104, 106 and 108 each have a similar height. Also, the height of the back most bristle tufts 110 is similar to the height of the bristle tufts 102, 104, 106 and 108 (see FIG. 1).

Figure 4:
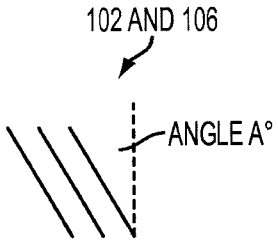
FIG. 4 is a side view of 3 bristles tufts arranged at an angle that is between 4 and 10 degrees to the left of the vertical position according to an embodiment of the invention.
Figure 5:
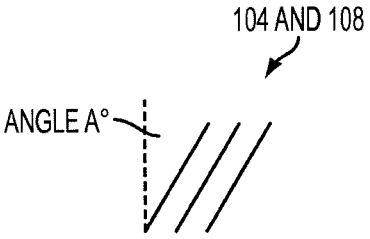
FIG. 5 is a side view of 3 bristles tufts arranged at an angle that is between 4 and 10 degrees to the right of the vertical position according to an embodiment of the invention.

The bristles tufts 101, 103, 105, 107 and 109 are arranged in an upward vertical position (0 degrees) that is perpendicular to a horizontal plane defined by the head 111. As shown in FIG. 4, the bristles tufts 102 and 106 are angled to the left by an angle A, which is preferably between 4 degrees and 10 degrees, and more preferably 7-9 degrees. As shown in FIG. 5, the bristles tufts 104 and 108 are angled to the right by an angle A, which is preferably between 4 degrees and 10 degrees, and more preferably 7-9 degrees. As shown, no bristle tufts on the toothbrush 100 are angled in the forward direction or the backward direction. That is, the bristle tufts are only angled towards the left, right or straight up. This advantageously results in the bristle tufts providing better cleaning of the teeth and improved plaque removal from the teeth.

These three angles (e.g., vertical, left and right) for the bristle tufts have been tested and proven to advantageously provide significantly improved plaque removal and more effective cleaning of both the tooth surface and the gumline. Also, the alternating heights in combination with the angles (i.e., the specific arrangement shown in FIGS. 1-5) of the bristle tufts have been tested and proven to advantageously provide significantly improved plaque removal and more effective cleaning of both the tooth surface and the gumline. For example, arranging an entire row of bristle tufts in a straight upward direction, an entire row of bristle tufts at an angle A to the left and an entire row of bristle tufts at an angle A to the right provides multi-levels and directions of better and consistent cleaning. Specifically, in independent third party testing, the three angles for the rows of bristle tufts (using floss bristles) resulted in sixteen (16) percent better plaque removal as compared to leading toothbrushes that are currently available. Also, in independent third party testing, the three angles for the rows of bristle tufts (not using floss bristles) in combination with the lower height for the vertical bristles resulted in eighteen (18) percent better plaque removal as compared to leading toothbrushes that are currently available. The toothbrushes and variations of bristle configurations described herein all resulted in similar improvements in cleaning and plaque removal as indicated in the test results provided by the independent third party when compared to leading toothbrushes that are currently available.

The oral care guidelines for brushing recommends a user place the bristles along the gumline and teeth at a 45 degree angle and brush away from the gumline in an up-down motion or movement of the toothbrush. During brushing, at least one row of bristle tufts are angled in the same direction as the tooth or gums and at least one row of bristle tufts are angled in the opposite direction as the tooth or gums during the up and down movement of the toothbrush. This advantageously allows the bristles to naturally flow, move, and clean and remove plaque in a more effective manner. This also advantageously allows the bristles to enter areas and travel deeper between the teeth to better remove plaque and other food items. This is due to the rows of bristle tufts being aligned such that a set of bristle tufts are angled to the left, a set of bristle tufts are angled to the right and a set of bristle tufts are positioned straight up. The "triple angle" bristles (i.e., left, right and straight up) maximize the surface area (i.e., the tooth surface and the gumline) that is cleaned and the number of angles that contact the tooth surface and the gums in the direction of brushing for better plaque removal and improved overall cleaning (i.e., at the gumline, on the tooth, between the teeth and on and between the back teeth and gums for hard to reach areas).

Figure 6:
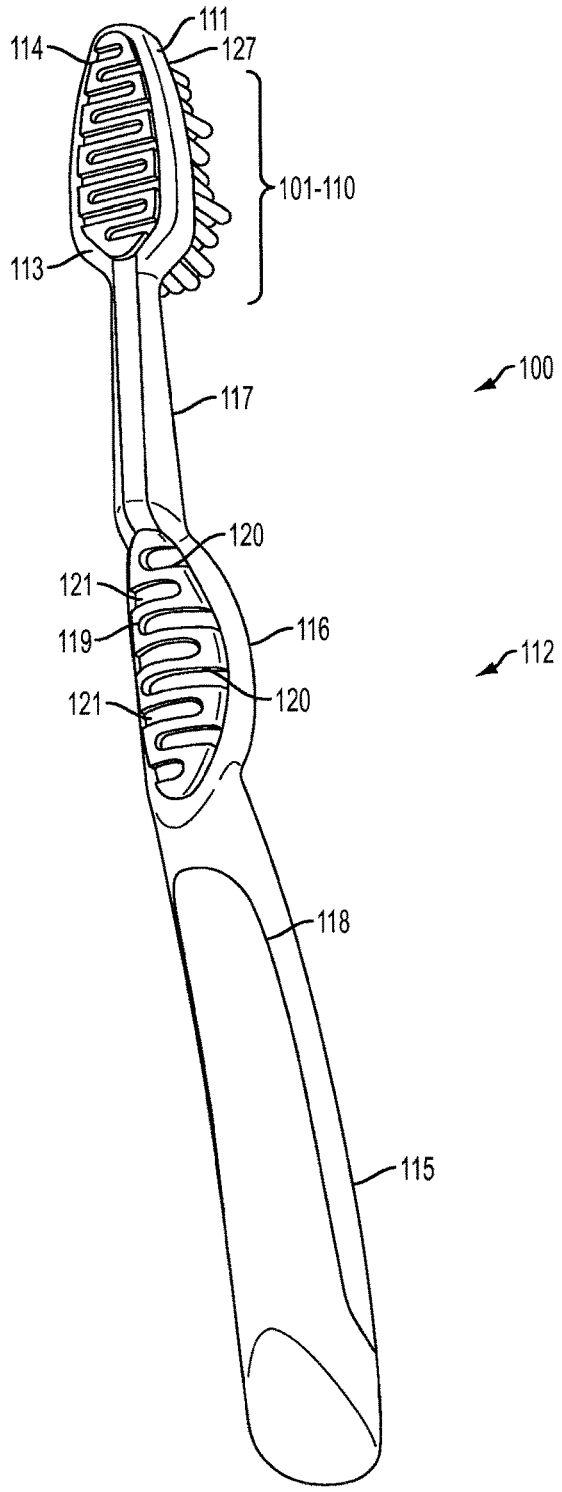
FIG. 6 is a perspective rear view of a head and a handle of a toothbrush according to an embodiment of the invention.

FIG. 6 is a perspective rear view of the head 111 and a handle 112 of the toothbrush 100 as described in relation to FIGS. 1-5. The bristles 101-110 extend from a ventral (i.e., top or underside) surface 127 (see also FIG. 7) of the head 111. A dorsal (i.e., rear or back) surface 113 of the head 111 is positioned opposite the ventral surface 127. A tongue scraper 114 is positioned on the dorsal surface 113 of the head 111.

The handle 112 includes a base 115, a center portion 116 (e.g., a shoulder 116), and a neck 117. The base 115 forms a bottom end of the toothbrush 100. The base 115 extends upward from the bottom end of the toothbrush 100 to a top end of the base 115 that is connected to a bottom end of the shoulder 116. The shoulder 116 extends upward from the bottom end of the shoulder 116 to a top end of the shoulder 116 that is connected to a bottom end of the neck 117. The neck 117 extends upward from the bottom end of the neck 117 to a top end of the neck 117 that is connected to the head 111.

Figure 9:
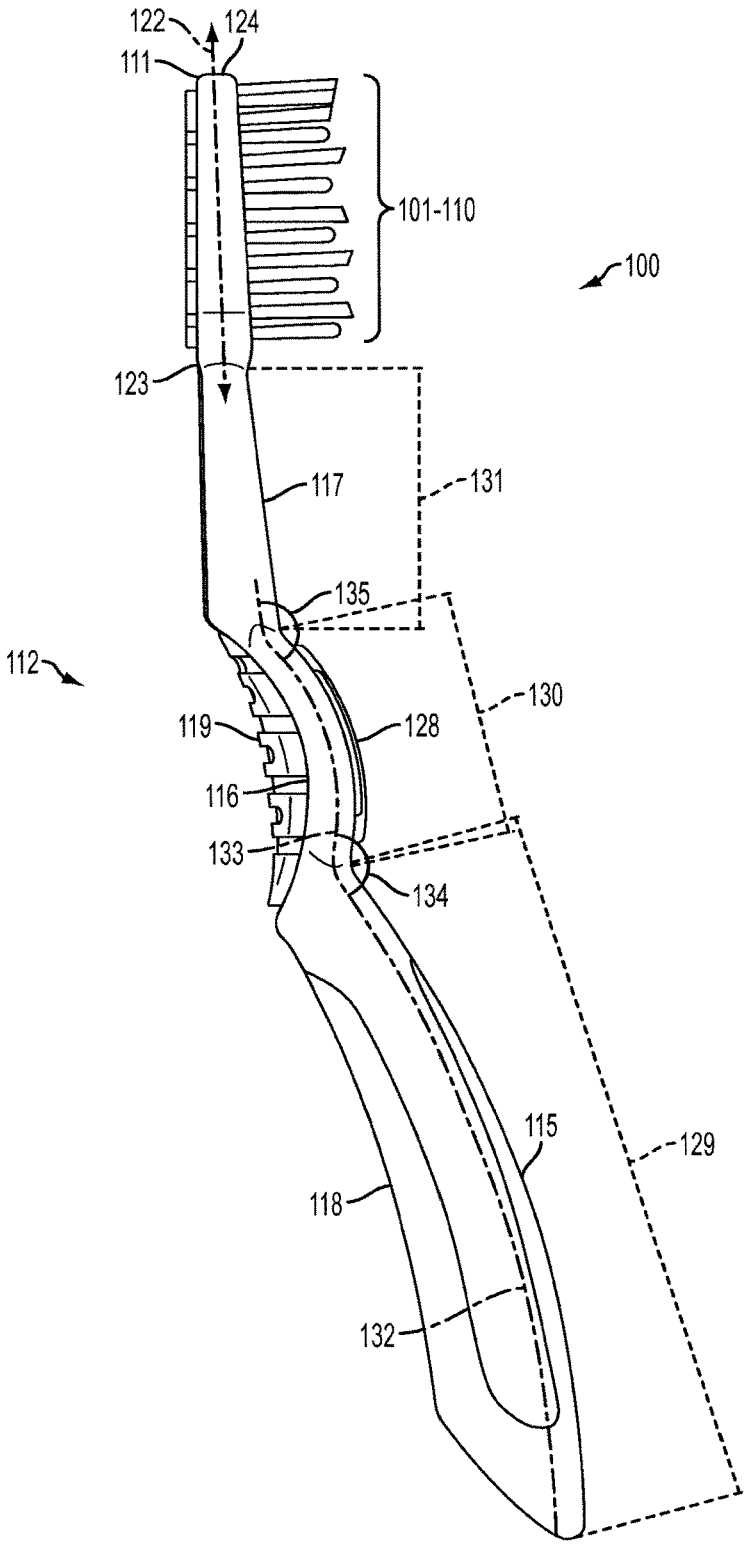
FIG. 9 is a left side view of the toothbrush shown in FIG. 6.

The base 115 has an elongate shape configured to rest in the palm of the user's hand when the toothbrush 100 is in use. As shown in FIG. 9, the base 115 may have a curved shape to contour the shape of the user's fingers or palm. The base 115 may include a base grip 118 of a softer material than the rest of the base 115 to provide comfort and a better grip for the user's fingers or palm when in use.

The shoulder 116 forms a finger grip for the toothbrush 100, for the thumb and index finger or multiple fingers of the user to grip when the toothbrush 100 is in use. The shoulder 116 has a curved shape that is curved convex (see also FIGS. 9 and 10) towards the front of the toothbrush 100 (the direction that the ventral surface 127 of the toothbrush 100 faces towards) for better comfort, handling, use and movement of the toothbrush 100. The curved convex shape of the shoulder 116 provides an improved grip area for the user's fingers when in use. A shoulder (or a rear) grip 119 may be positioned on the dorsal surface of the shoulder 116. The shoulder grip 119 may be formed of a soft (e.g., rubber) material positioned on the dorsal surface of the shoulder 116, for the user's fingers to grip to improve the user's ability to hold the toothbrush 100. The shoulder grip 119 may include raised portions 120 and lowered portions 121 forming a grip surface area for the user's fingers. The raised portions 120 may be connected to each other, and may be formed as portions extending in a transverse direction relative to the longitudinal direction of the handle 112 connected by shorter portions extending along the longitudinal direction of the handle 112. The lowered portions 121 extend in a transverse direction relative to the longitudinal direction of the handle 112. In this manner, the raised portions 120 may form a zig-zag pattern extending along the dorsal surface of the shoulder 116. The raised portions 120 form ridges on the dorsal surface that are adjacent to the channels formed by the lowered portions 121. A similar pattern of raised and lowered portions may form the tongue cleaner or scraper 114 that is on the dorsal surface 113 of the head 111.

The neck 117 is an elongate portion of the handle 112 that connects the shoulder 116 to the head 111. The neck 117 may have a straightened shape and be made of a hard plastic material.

Figure 7:
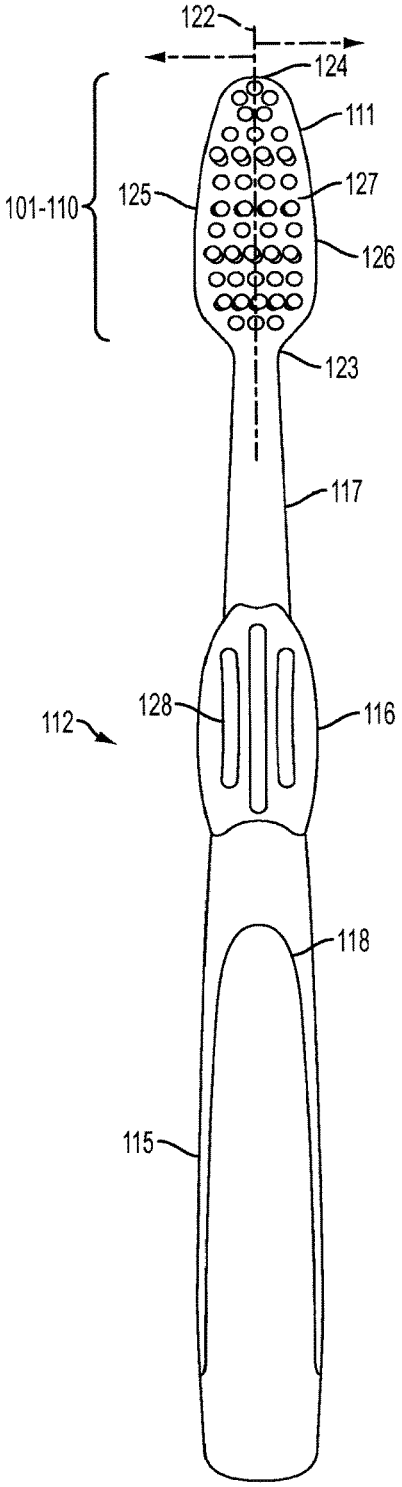
FIG. 7 is a front view of the toothbrush shown in FIG. 6.

FIG. 7 is a front view of the toothbrush 100, with the plurality of bristles 101-110 in the configuration described in relation to FIGS. 1-5. The handle 112 extends in a longitudinal direction that forms the elongate shape of the handle 112 as seen in the front view. The head 111 extends along an axis 122 extending along the longitudinal direction. The axis 122 extends from the end 123 of the head 111 that is proximal the neck 117 to the end 124 of the head 111 that is distal the neck 117. Each row of the bristles 101-109 is aligned to extend in a direction transverse to the axis 122. Each row of the bristles 101-109 may be aligned to extend in a direction substantially perpendicular to the axis 122. Each row is substantially parallel to an adjacent row.

The bristle tufts that are angled, as shown in FIG. 4 and FIG. 5, for example, may be angled in a direction transverse to the axis 122. The bristle tufts 102 and 106, for example, may be angled towards the side 125 of the head 111 that is positioned between the proximal end 123 and the distal end 124 of the head 111 (the left side 125 of the head 111 as seen from a front view). The bristle tufts 104 and 108, for example, may be angled towards the side 126 of the head 111 that is positioned between the proximal end 123 and the distal end 124 of the head 111 (the right side 126 of the head 111 as seen from a front view). The sides 125, 126 of the head 111 extend in a longitudinal direction along the head 111, and extend from the ventral surface 127 of the head 111 to the dorsal surface 113 seen in FIG. 6. The bristle tufts 102, 104, 106, 108 may each be angled in a direction substantially perpendicular to the axis 122 (with tufts 102 and 106 angled in an opposite direction than tufts 104 and 108).

A shoulder (or a front or finger) grip 128 may be positioned on the ventral surface of the shoulder 116. The shoulder grip 128 may be made of a soft material and may include multiple (e.g., 3) raised linear portions extending in a longitudinal direction along the handle 112 or the shoulder 116. The shoulder grip 128 provides improved grip and control for the user's thumb when the toothbrush 100 is in use. The combination of the rear grip 119 and the front grip 128 provide multi-direction handling and control, comfort, non-slip grips or surfaces and a sleek and easy to use handle.

Figure 8:
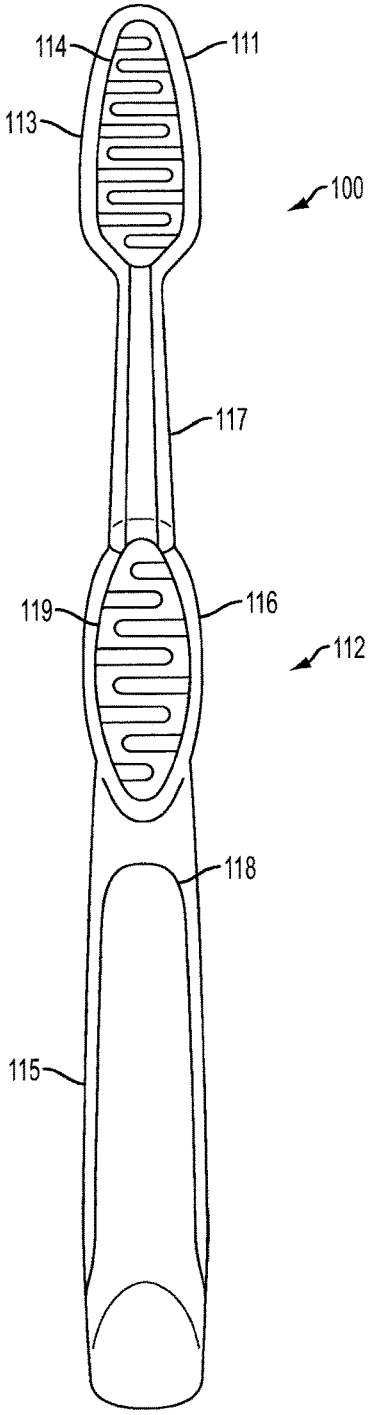
FIG. 8 is a rear view of the toothbrush shown in FIG. 6.

FIG. 8 is a rear view of the toothbrush 100.

FIG. 9 is a left side view of the toothbrush 100, showing the curvature of the base 115 and the curvature of the shoulder 116. The base 115 includes a curved shape that is curved outward toward the front of the toothbrush or curved convex towards the front of the toothbrush 100 (the direction that the ventral surface of the toothbrush 100 faces towards). The curvature of the base 115 allows the base 115 to extend inward towards the user's palm when the toothbrush is in use. The shoulder 116 also includes a curved shape that is curved outward toward the front of the toothbrush 100 or curved convex towards the front of the toothbrush 100. The curvature of the shoulder 116 may be different than and greater than the curvature of the base 115. The increased curvature of the shoulder 116, relative to the remainder of the handle 112 and particularly the base 115, allows the shoulder 116 to take up a shorter proportional longitudinal distance along the toothbrush 100 but also have an increased surface area relative to the other portions of the toothbrush 100.

For instance, a direct distance 129 from end to end of the base 115 may be of a certain value. A direct linear distance 130 from end to end of the shoulder 116 may be of a value that is about 35 percent to 45 percent of the linear distance 129 of the base 115, and is preferably about 40 percent of the distance 129. A direct linear distance 131 from end to end of the neck 117 may also be of a value that is about 35 percent to 45 percent of the distance 129 of the base 115, and also preferably is about 40 percent of the distance 129. In one embodiment, the shoulder 116 may form between about 15 percent to 20 percent of the total length of the toothbrush 100, using the end to end distance measures including the end to end distance measure of the head 111, and is preferably between about 17 percent and 18 percent of the total length of the toothbrush 100.

The distance, however, as taken along the curvature of the respective base 115, shoulder 116, and neck 117 varies to reflect the curvature of the shoulder 116. For instance, a distance 132 along the curvature of the base 115 from end to end may be of a certain value. A distance 133 along the curvature of the shoulder 116 from end to end may be of a value that is about 40 percent to 50 percent of the distance 132 of the base 115, and is preferably about 45 percent of the distance 132 of the base 115. The distance 133 along the curvature of the shoulder 116 is larger than the distance 130 of the shoulder 116 from end to end, based on this geometry (i.e., the relative percentage of the distance 133 provided is larger than the relative percentage of the distance 130 provided). The neck 117 as shown has no curvature. The relative distance of the neck 117 remains at a value that is about 35 percent to 45 percent of the distance 132 along the curvature of the base 115.

As such, the curvature of the shoulder 116 allows the shoulder to have a relatively large surface area relative to the other portions of the toothbrush 100, yet have a shorter proportional longitudinal distance along the toothbrush 100. The distance 133 along the curvature of the shoulder 116 is proportionally larger than the distance 130 from end to end of the shoulder 116 when compared to similar measurements taken along the base 115 or other portions of the toothbrush 100. The increased surface area of the shoulder 116 provides an improved area of grip along the ventral side of the shoulder 116 for the thumb to contact, without unnecessarily increasing the total length of the toothbrush 100. The convex curvature of the shoulder 116 also provides an indented surface along the dorsal side of the shoulder 116 for cupping or partially extending around the user's index finger, or other fingers. The relative position that results when the user grips the shoulder 116 between the user's thumb and index finger allows for improved control of the toothbrush 100 when performing pivoting motions and brushing motions of the toothbrush 100.

The lower end of the shoulder 116 connects to the upper end of the base 115 at an angle 134 of inflection between the curvature of the base 115 and the curvature of the shoulder 116. The arcs that the shoulder 116 and the base 115 extend along intersect at the point of inflection between the shoulder 116 and the base 115. Similarly, the upper end of the shoulder 116 connects to the lower end of the neck 117 at an angle 135 of inflection between the curvature of the shoulder 116 and the extent of the neck 117 (the angle 135 may be between the curvature of the shoulder 116 and the axis 122 of the head 111). The arc that the shoulder 116 extends along intersects the extent of the neck 117 at the point of inflection between the shoulder 116 and the neck 117.

The shoulder 116 has a greater radius of curvature than the base 115. The shoulder grips 119, 128 may curve with the shoulder 116 or may have a different curvature than the shoulder 116. The outer surfaces (including the ventral or dorsal surfaces) of the shoulder 116 or the base 115 may curve with the respective shoulder 116 or the base 115 or may have a different curvature than the respective shoulder 116 or base 115.

Exemplary measurements of the handle 112 follow. The base 115 may have a distance 129 as described of between about 8 centimeters (hereinafter "cm") and 9 cm, and preferably between about 8.3 cm and 8.6 cm. The shoulder 116 may have a distance 130 as described between about 2.8 cm and 4.0 cm, and preferably between about 3.3 cm and 3.6 cm. The neck 117 may have a distance 131 as described between about 2.8 cm and 4.0 cm, and preferably between about 3.3 cm and 3.6 cm.

The base 115 may have a distance 132 as described of between about 8 cm and 9 cm, and preferably between about 8.4 cm and 8.7 cm. The shoulder 116 may have a distance 133 as described between about 3.2 cm and 4.5 cm, and preferably between about 3.7 cm and 4.2 cm. The distance 133 will be larger than the distance 130 based on the geometry of the shoulder 116.

The angle 134 of inflection between the curvature of the base 115 and the curvature of the shoulder 116 is between about 140 degrees and 155 degrees and is preferably between about 145 degrees and 149 degrees. The angle 135 of inflection between the curvature of the shoulder 116 and the extent of the neck 117 is also between about 140 degrees and 155 degrees and is preferably between about 145 degrees and 149 degrees. The angles of inflection 134, 135 may therefore be approximately equal if desired.

The radius of curvature of the shoulder 116 is between about 3.5 cm and 4.75 cm and is preferably between about 3.7 cm and 4.0 cm. The radius of curvature of the base 115 is between about 13 cm and 15 cm, and is preferably between about 14.3 cm and 14.8 cm. The radius of curvature of the base 115 is greater than the radius of curvature of the shoulder 116, and may be greater than the radius of curvature of the shoulder 116 by a multiple of between 3.5 and 4.

The values provided in this application are exemplary and may be varied if desired in one embodiment.

Figure 10:
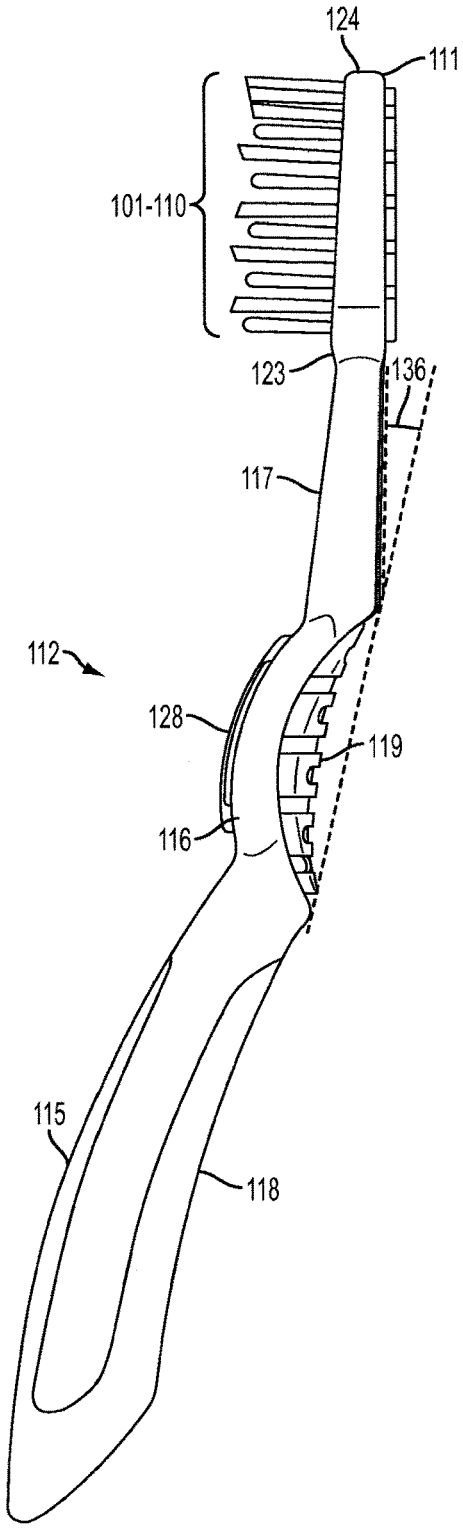
FIG. 10 is a right side view of the toothbrush shown in FIG. 6.

FIG. 10 is a right side view of the toothbrush 100. FIG. 10 illustrates an angle 136 of the neck 117 and the head 111 relative to the portions of the shoulder 116 that are positioned the furthest most dorsal of the handle 112. The angle 136 may be between about 10 degrees and 15 degrees and is preferably about 13 degrees. The angled neck 117 and the head 111 may provide for improved access to the deepest teeth in the user's mouth (e.g., the back molars). The value of the angle 136 is exemplary and may be varied if desired in one embodiment.

Figure 11:
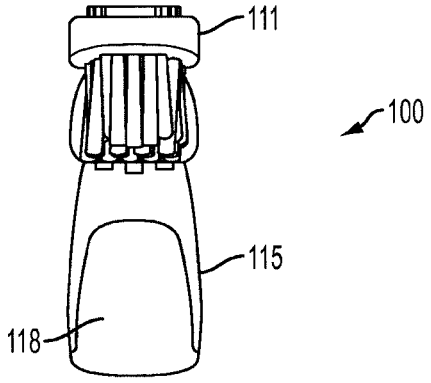
FIG. 11 is a top view of the toothbrush shown in FIG. 6.
Figure 12:
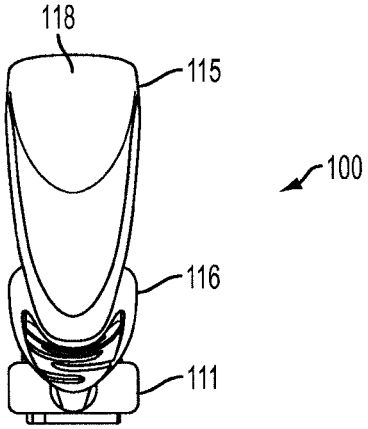
FIG. 12 is a bottom view of the toothbrush shown in FIG. 6.

FIG. 11 is a top view of the toothbrush 100. FIG. 12 is a bottom view of the toothbrush 100.

Figure 13:
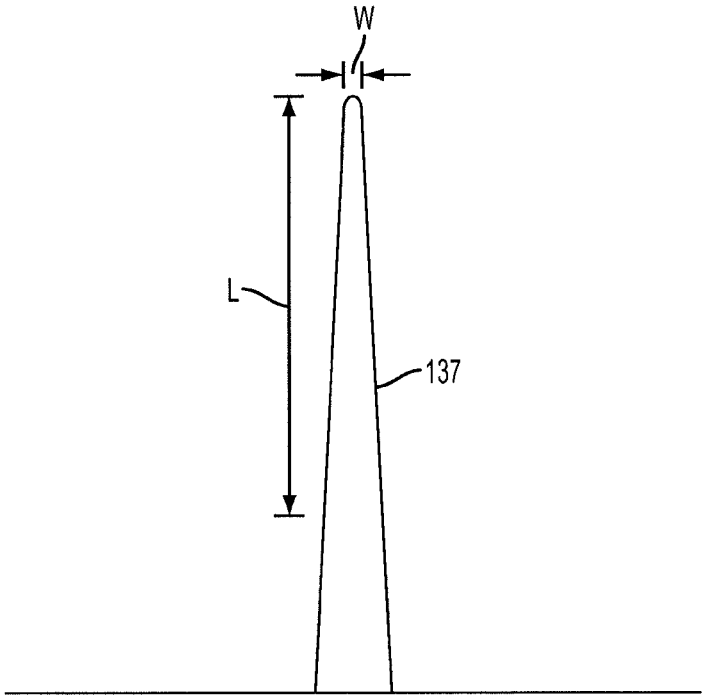
FIG. 13 is a side representation of a bristle for use with a toothbrush according to an embodiment of the invention.

FIG. 13 is a side representation of a single bristle 137 for use with the toothbrush 100 as described herein, or other toothbrushes described herein. The bristle 137 is configured as a tapered bristle, which tapers from a larger diameter at the bristle's 137 base, to a smaller diameter at the bristle's 137 tip. The bristle 137 may taper continuously along its length L (about 5 mm) from the base to the tip. The bristle 137 may taper from a diameter of about 0.15 millimeters (hereinafter "mm") at its base to a diameter W of about 0.01 mm at its tip. The bristle 137 accordingly has a diameter at its tip that is narrower that the ADA standard for "soft" bristles, which is about 0.2 mm. The narrow diameter of the bristle 137 allows for improved penetration into the spaces between the user's teeth, to more effectively remove plaque and debris located in those interdental spaces. The bristle 137 may have a length from base to tip between about 1 cm and 1.5 cm, and is preferably between about 1.2 cm and about 1.3 cm.

Figure 14:
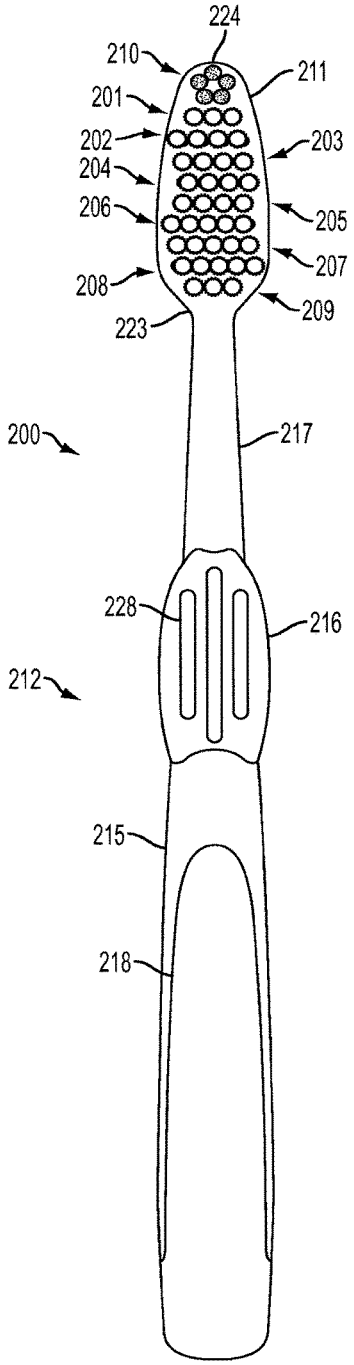
FIG. 14 is a front view of a toothbrush according to an embodiment of the invention.

FIG. 14 is a front view of a toothbrush 200, which may use the bristles 137 shown in FIG. 13. The bristles 137 are grouped together into the bristle tufts 201-209 shown in FIG. 14. The features of toothbrush 200 are similar as the features of toothbrush 100, with similar features having the first reference number of "1" changed to the reference number of "2" to reflect that toothbrush 200 includes the bristles 137. The bristle tufts 201-209 are angled in a similar manner as in regard to the bristle tufts 101-109, with the bristle tufts 201, 203, 205, 207 and 209 positioned vertically, the bristle tufts 202 and 206 angled towards one side (e.g., left) of the head 211, and the bristle tufts 204 and 208 angled towards the other side (e.g., right) of the head 211.

Figure 15:
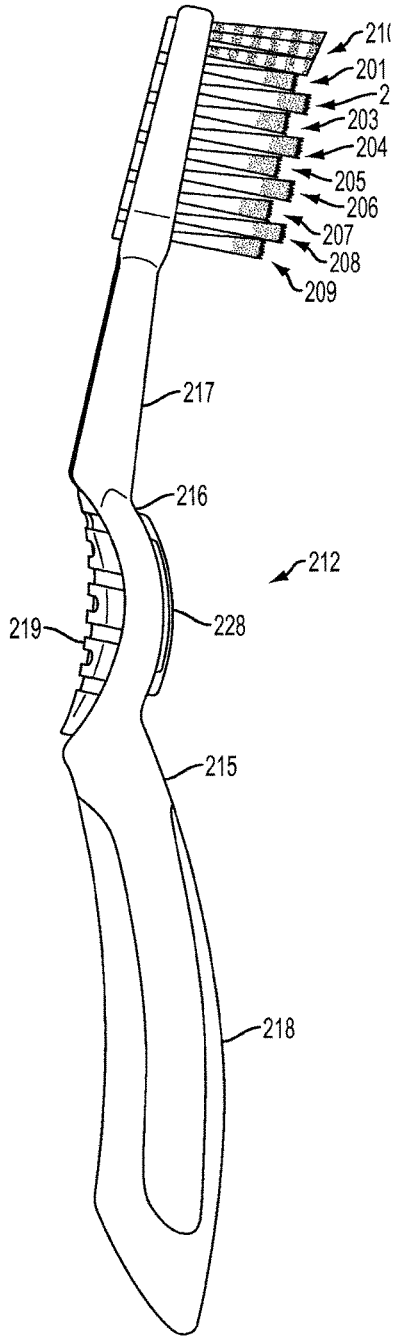
FIG. 15 is a left side view of the toothbrush shown in FIG. 14.

FIG. 15 is a left side view of the toothbrush 200. As shown, the bristle tufts 201, 203, 205, 207 and 209 have a height that is less than a height of bristle tufts 202, 204, 206 and 208. Hence, every alternating row has the same height.

Figure 16:
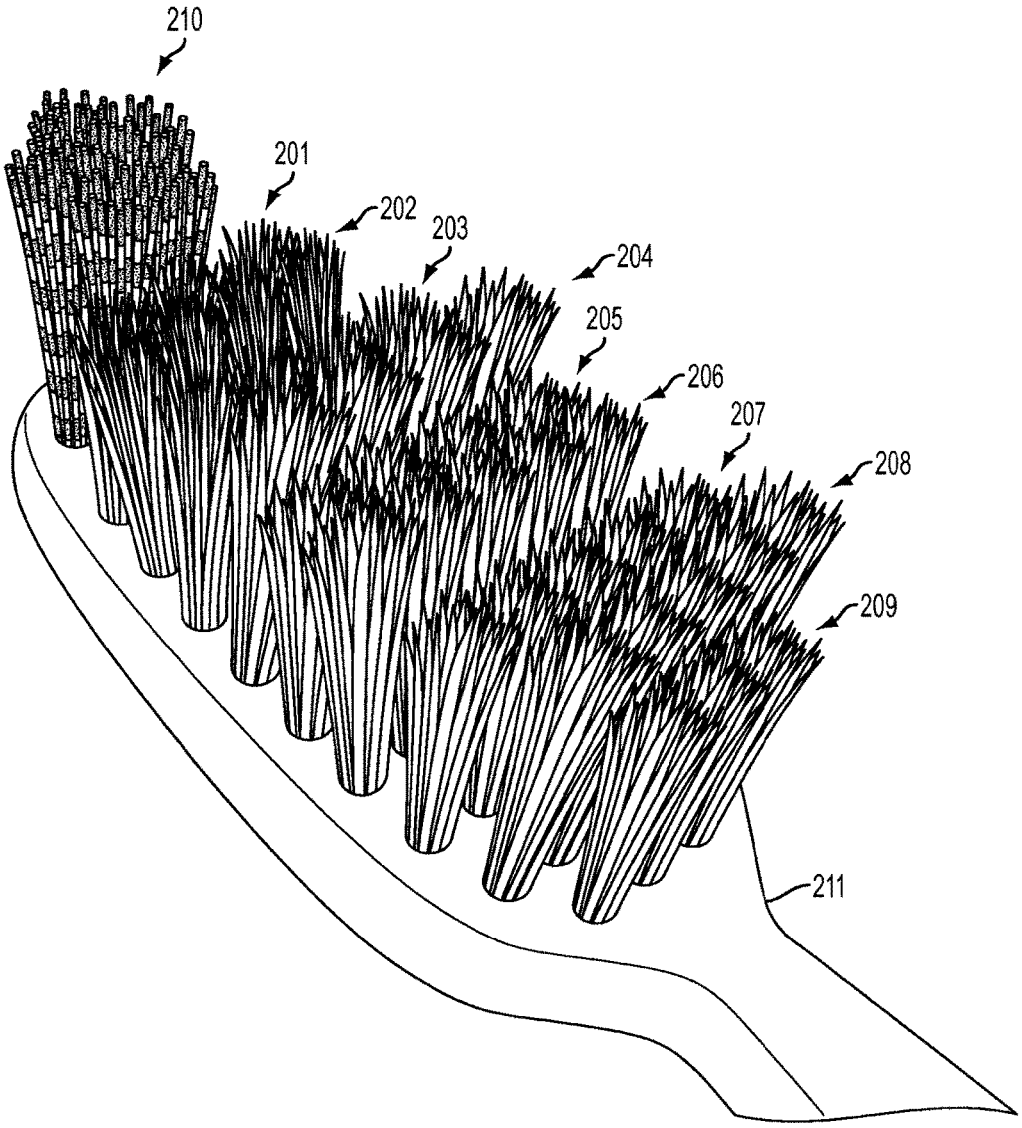
FIG. 16 is a side perspective view of the toothbrush head of the toothbrush shown in FIG. 14.

FIG. 16 is a side perspective view of the toothbrush head 211. The bristles forming tufts 201-209 have been tapered along their lengths from the base of the respective tufts 201-209. The bristles forming tuft 210 may have bristle ends that have not been tapered along their lengths. In one embodiment, the bristles forming tuft 210 may also be tapered along their lengths in a manner described in regard to bristle 137.

Figure 17:
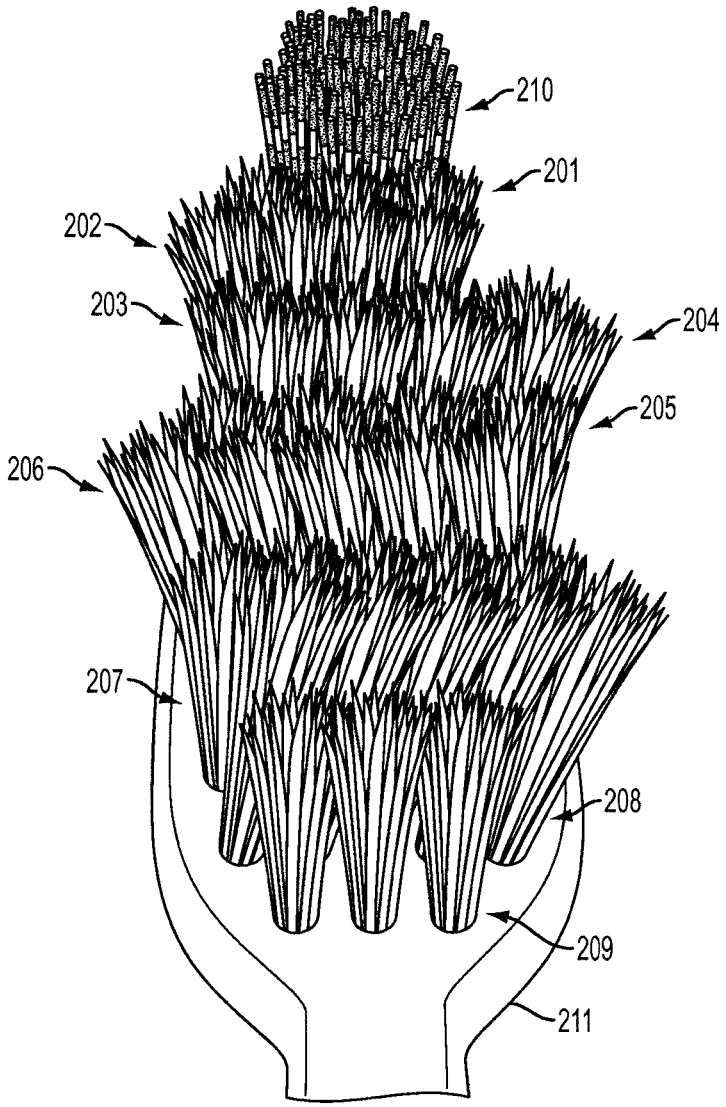
FIG. 17 is an end perspective view of the toothbrush head of the toothbrush shown in FIG. 14.

FIG. 17 is an end perspective view of the toothbrush head 211.

Figure 18:
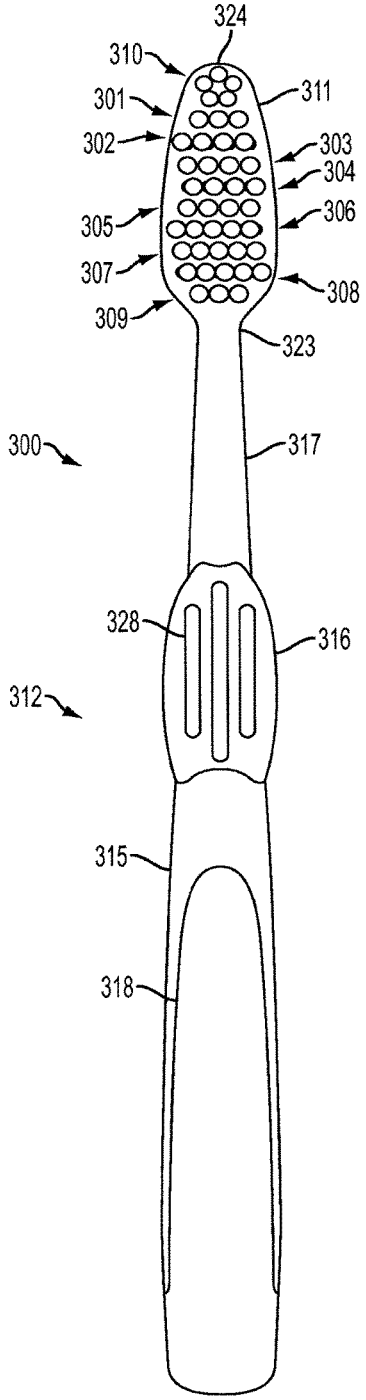
FIG. 18 is a front view of a toothbrush according to an embodiment of the invention.

FIG. 18 is a front view of a toothbrush 300, which includes bristle tufts having free ends that are angled. The features of toothbrush 300 are similar as the features of toothbrush 100, with similar features having the first reference number of "1" changed to the reference number of "3" to reflect that toothbrush 300 includes bristle tufts having free ends that are angled. The entire bristle tufts 301-309 are angled in directions in a similar manner as in regard to the bristle tufts 101-109, with the bristle tufts 301, 303, 305, 307 and 309 positioned vertically, and the bristle tufts 302 and 306 angled towards one side (e.g., left) of the head 311, and the bristle tufts 304 and 308 angled towards the other side (e.g., right) of the head 311.

Figure 19:
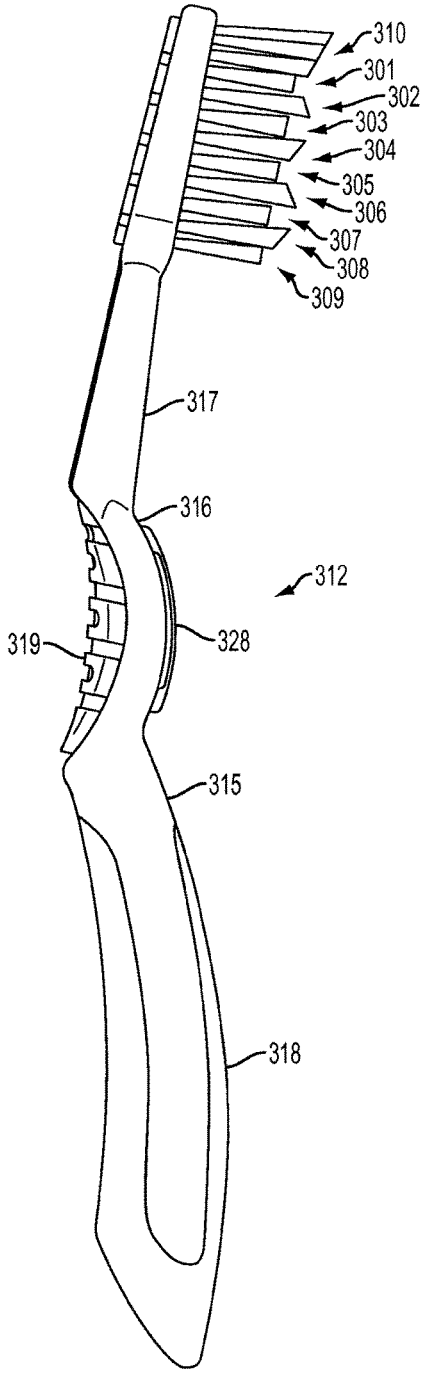
FIG. 19 is a left side view of the toothbrush shown in FIG. 18.

FIG. 19 is a left side view of the toothbrush 300. The bristle tufts that are angled towards a side of the toothbrush head 311 have a bristle profile (appearance of the free end of the bristle tuft from a side view) that is also angled. The bristle tufts 302 and 306 have free ends that angle downward towards the ventral surface of the head 311 as the bristle tufts 302 and 306 extend in a direction towards the distal end 324 of the head 311. The bristle tufts 304 and 308 have free ends that angle upward away from the distal end of the head 311 as the bristle tufts 304 and 308 extend in a direction towards the distal end 324 of the head 311. The bristle tufts 301, 303, 305, 307 and 309 have free ends that are substantially flat. The direction of the angle of the bristle profile (i.e., ends) of the bristle tufts 302, 304, 306 and 308 alternates upward and downward for the rows of the bristle tufts 302, 304, 306 and 308.

Figure 20:
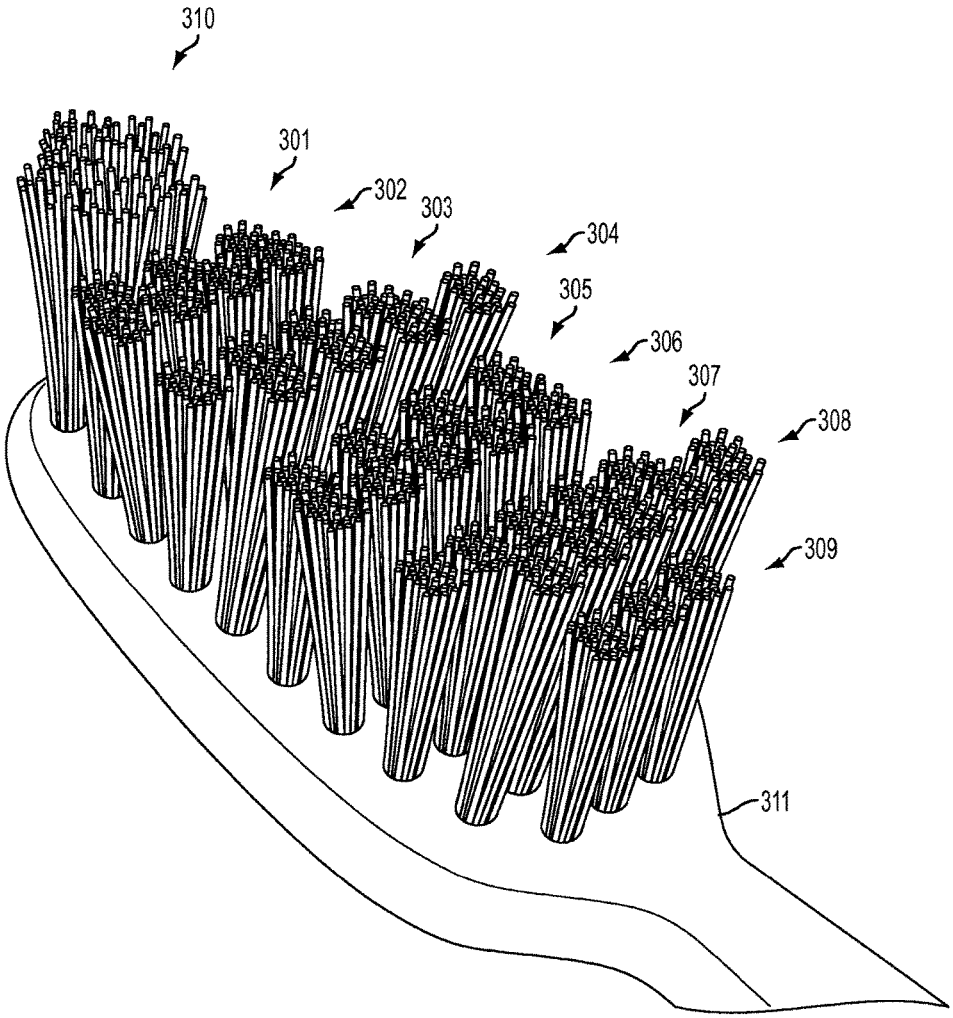
FIG. 20 is a side perspective view of the toothbrush shown in FIG. 18.

FIG. 20 is a side perspective view of the toothbrush head 311. The bristles forming tufts 301-310 have bristle ends that have not been tapered along their lengths. In one embodiment, the bristles forming tufts 301-310 may also be tapered along their lengths in a manner described in regard to bristle 137.

Figure 21:
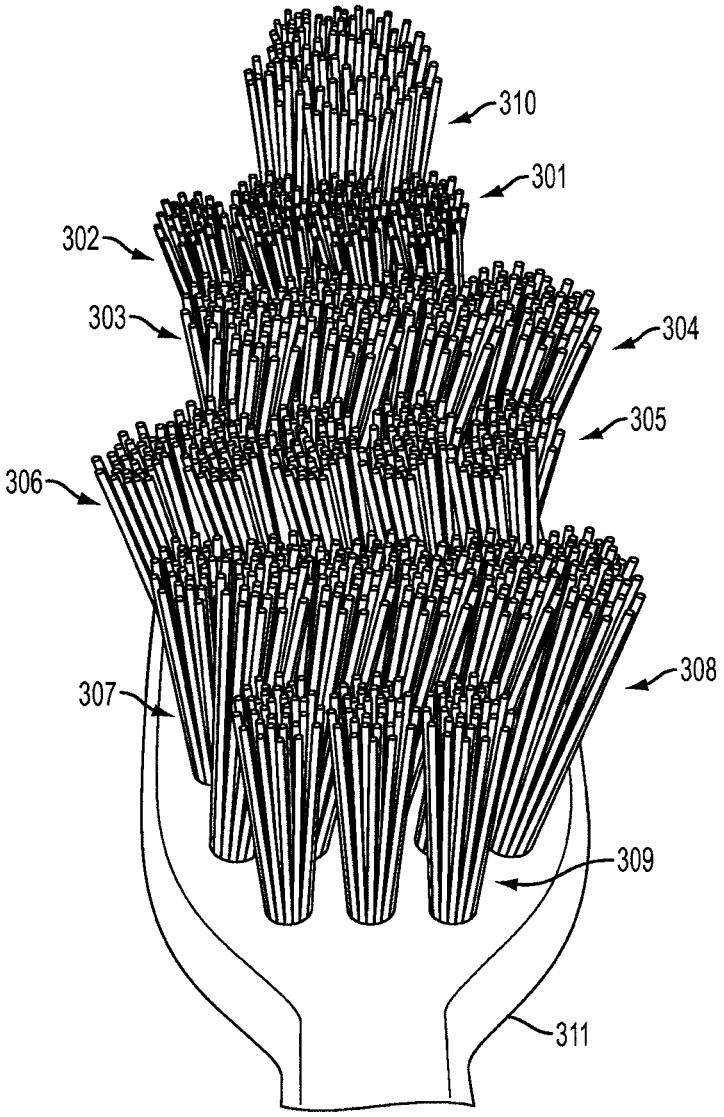
FIG. 21 is an end perspective view of the toothbrush head of the toothbrush shown in FIG. 18.

FIG. 21 is an end perspective view of the toothbrush head 311.

Figure 22:
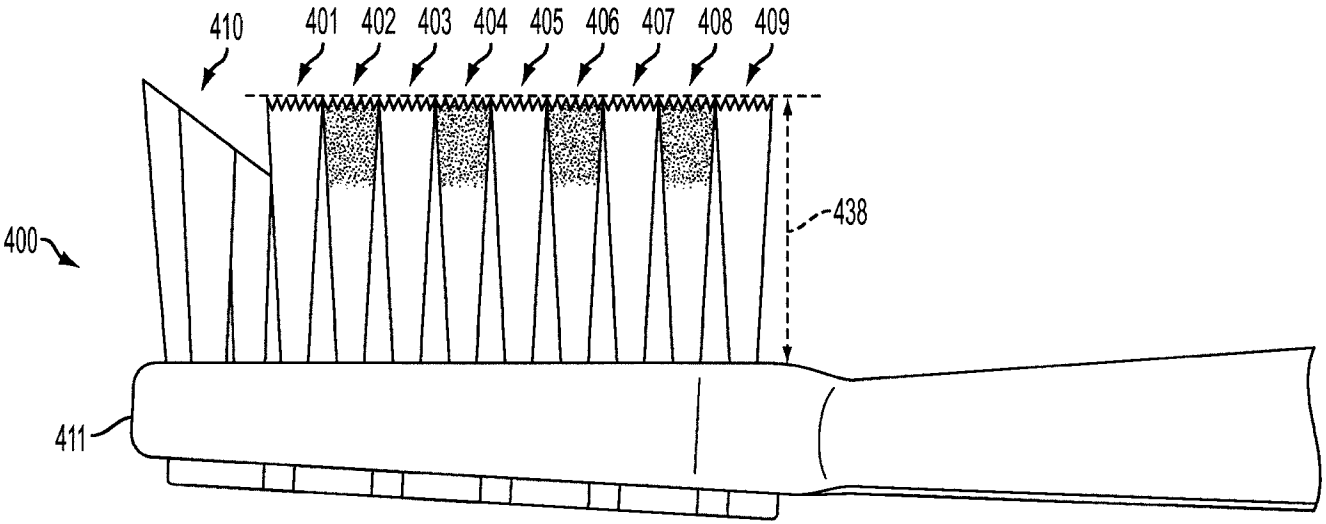
FIG. 22 is a side view of a head of a toothbrush according to an embodiment of the invention.

FIG. 22 is a side view of a head 411 of a toothbrush 400, which uses the bristles 137 shown in FIG. 13. The features of toothbrush 400 are similar as the features of toothbrush 100, with similar features having the first reference number of "1" changed to the reference number of "4" to reflect that toothbrush 400 includes bristles 137. The bristle tufts 401-409 are angled in directions in a similar manner as in regard to the bristle tufts 101-109, with the bristle tufts 401, 403, 405, 407 and 409 angled vertical, and the bristle tufts 402 and 406 angled towards one side of the head 411, and the bristle tufts 404 and 408 angled towards the other side of the head 411. The bristle tufts 401-409 all have the same height 438 from the ventral surface of the head 411, even though certain bristle tufts 402, 404, 406 and 408 are angled to one side of the toothbrush 400.

Figure 23:
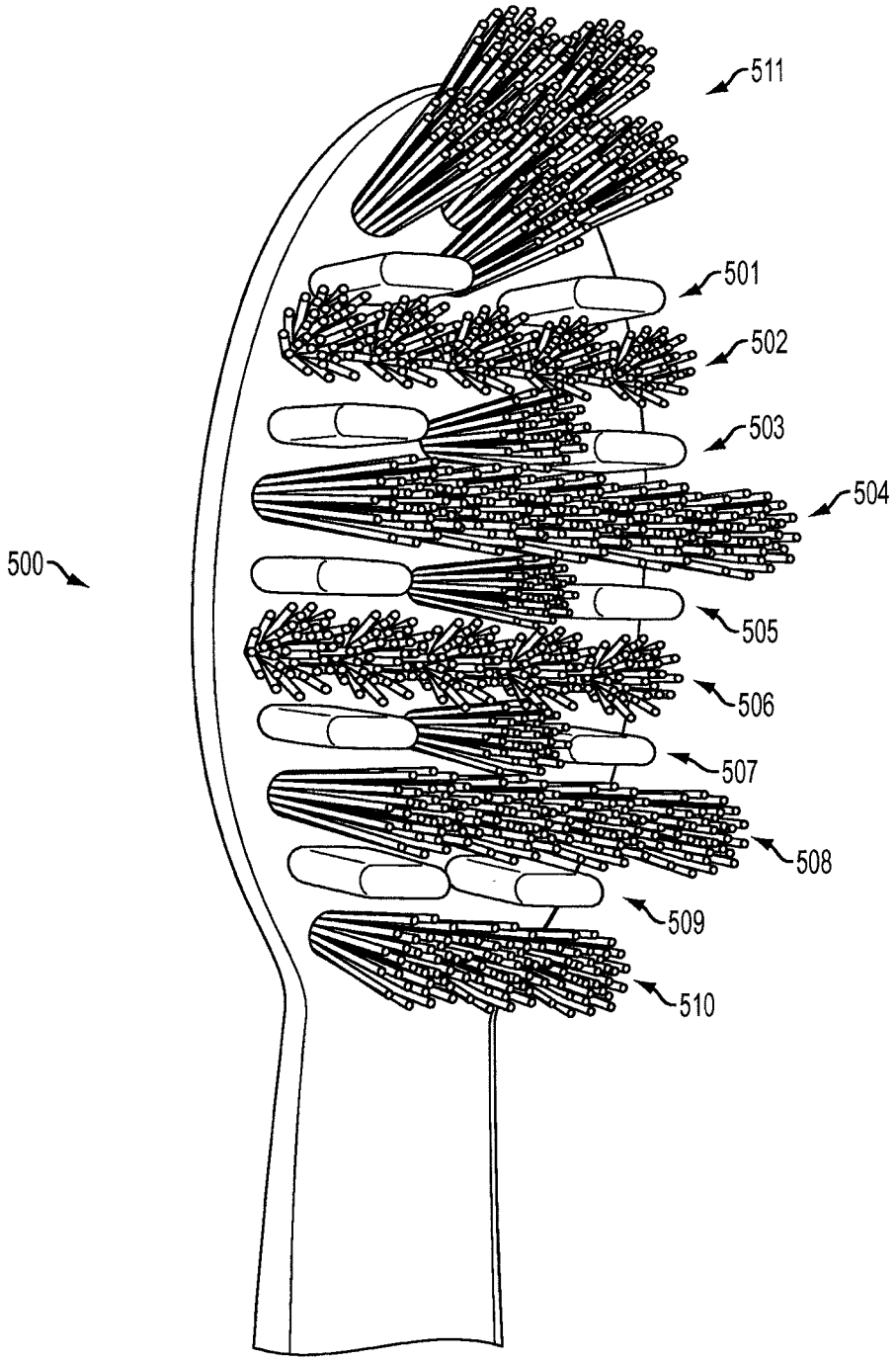
FIG. 23 is a top perspective view of a toothbrush head according to an embodiment of the invention.
Figure 24:
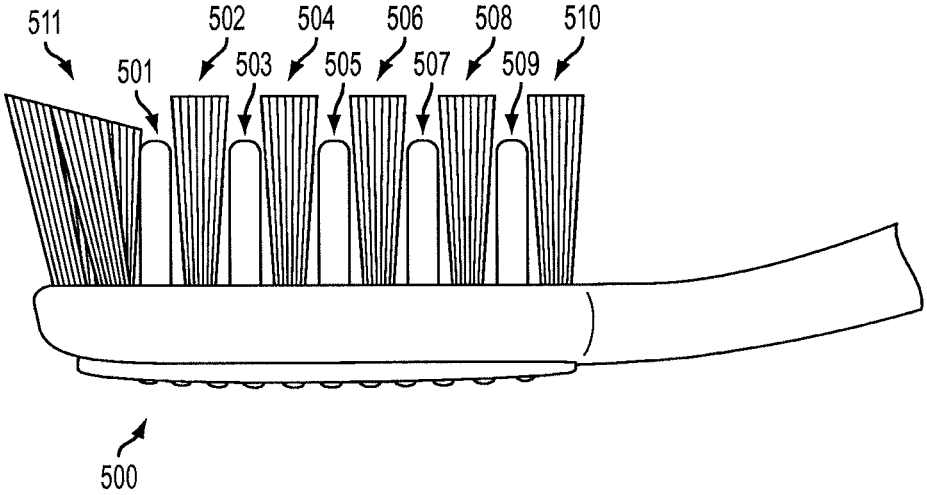
FIG. 24 is a side view of the toothbrush head of FIG. 23 according to an embodiment of the invention.

FIG. 23 is a top perspective view of a toothbrush head 500. FIG. 24 is a side view of the toothbrush head 500 of FIG. 23. Referring to FIGS. 23 and 24, the top set of bristle tufts 511 includes 6 bristle tufts that are arranged in a circular configuration. The top set of bristle tufts 511 are generally referred to as a toe tuft. As shown in FIG. 24, the bristle tufts 511 are arranged at a downward angle where the front most bristle tufts have a higher height than the back most bristle tufts. As an example, each bristle tuft may be arranged in the shape of a circle, a rectangle, a square, an elliptical or an oval. The top set of bristle tufts 511 being arranged in a circular configuration and arranged at a downward angle improves teeth and gum cleaning in hard to reach areas and locations between and around the teeth and gums.

The bristle tufts 502, 504, 506, 508 and 510 are all arranged in a row pattern. For example, the set of bristle tufts 502, 504 and 506 each include 5 bristle tufts that are arranged along a row where each row is substantially parallel to one another. The set of bristle tufts 508 include 4 bristle tufts that are arranged along a row and the set of bristle tufts 510 include 3 bristle tufts that are arranged along a row. The number of bristle tufts per each row can vary and depends on the size of the head 500. The bristles tufts are all arranged in an upward vertical position that is perpendicular to a horizontal plane defined by the head. Between each row of bristle tufts, at least two plastic inserts (e.g., thermoplastic elastomers) 501, 503, 505, 507 and 509 are positioned to help massage the gumline and provide polishing on the tooth enamel. Between some of the plastic inserts in the row direction, one or more bristle tufts may be positioned. For example, one bristle tuft is positioned between the plastic inserts 503, 505 and 507. No bristle tufts are positioned in the row direction, between the plastic inserts 501 and 509. As shown in FIG. 24, the plastic inserts 501, 503, 505, 507 and 509 all have a height that is less than the height of the bristle tufts 502, 504, 506, 508 and 510.

The toothbrushes 100, 200, 300, 400, 500 and the bristles/bristle tufts described herein have been tested and proven to be more effective at cleaning teeth and removing plaque. The three different angles of bristle cleaning, with left, straight, and right angles of cleaning improves vertical surface contact for improved plaque removal and total mouth cleaning. The configuration of the grip, with a large base and shoulder improves control of the brush. The use of bristles narrowly tapered along their lengths, and bi-level bristle tufts additionally improves removal of plaque. As discussed in regard to the toothbrush 100, the rows of the bristle tufts angled towards opposing sides of the toothbrush head will allow the bristle tufts to more effectively sweep against the outer surfaces of the tooth. For example, if the head of the toothbrush 100 is swept in an up and down motion against a buccal surface of a tooth, with the handle extending out of the user's mouth, then the rows of bristle tufts angled towards the direction of motion produces a more aggressive brush of the tooth surface. The rows of the bristle tufts angled away from the direction of motion produces a less aggressive brush of the tooth surface. The more aggressive brushing angle may serve to more effectively remove tough plaque and debris, while the less aggressive brushing angle may serve to more effectively polish the tooth surface. As the toothbrush head is swept up and down, the combination of the more aggressive and less aggressive brushing will continue in both directions to cause more effective removal of plaque and debris and polishing of the teeth. This effect may be produced through similar motions of the toothbrush head on both the lingual and occlusal surfaces of the tooth. As such, the rows of bristle tufts angled in opposing directions towards the sides of the head improve the overall quality of teeth cleaning. The configuration of the handle, including the base and grip, improve the ability of the user to pivot the toothbrush, sweeping the toothbrush in a motion that goes with and against the direction that the rows of bristle tufts are angled towards.

References to "various embodiments", in "some embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

The foregoing description of the disclosed example embodiments is provided to enable any person of ordinary skill in the art to make or use the present invention. Various modifications to these examples will be readily apparent to those of ordinary skill in the art, and the principles disclosed herein may be applied to other examples without departing from the spirit or scope of the present invention. The described embodiments are to be considered in all respects only as illustrative and not restrictive and the scope of the invention is, therefore, indicated by the following claims rather than by the foregoing description. All changes which come within the meaning and range of equivalency of the claims are to be embraced within their scope.

What is claimed is:

1. A toothbrush having a distal end and a proximal end, the toothbrush comprising:

a head portion located at the distal end;

a plurality of bristles coupled to the head portion and extending outward in a ventral direction;

a neck portion having a neck portion distal end and a neck portion proximal end, the neck portion being coupled to the head portion at the neck portion distal end;

a shoulder portion having a shoulder portion distal end and a shoulder portion proximal end, the shoulder portion being coupled to the neck portion at the shoulder portion distal end and the neck portion proximal end, and the shoulder portion being curved toward the ventral direction;

a base portion located at the proximal end, the base portion having a base portion distal end and a base portion proximal end, the base portion being coupled to the shoulder portion at the base portion distal end and the shoulder portion proximal end, the base portion being curved toward the ventral direction; and further comprising a rear shoulder grip located on a dorsal surface of the shoulder portion, such that the rear shoulder grip contacts a user's fingers to improve the user's ability to hold the toothbrush, the dorsal surface of the shoulder portion being curved toward the ventral direction.

2. The toothbrush of claim 1, wherein the rear shoulder grip includes raised portions and lowered portions, the raised portions connected to each other and forming a zig-zag pattern across the dorsal surface of the shoulder portion.

3. A toothbrush having a top end, a bottom end, a front, and a back, the toothbrush comprising: a head portion located at the top end including bristles extending outward from the head portion on the front; and a handle portion including: a neck portion having a neck portion top end and a neck portion bottom end, a shoulder portion having a shoulder portion top end and a shoulder portion bottom end and being curved toward the front, and a base portion having a base portion top end and a base portion bottom end and being curved toward the front, the head portion connected to the neck portion top end, the neck portion bottom end connected to the shoulder portion top end, and the shoulder portion bottom end connected to the base portion top end;

further comprising a rear shoulder grip located on a back surface of the shoulder portion, such that the rear shoulder grip contacts a user's fingers to improve the user's ability to hold the toothbrush; and wherein the rear shoulder grip includes raised portions and lowered portions, the raised portions connected to each other and forming a zig-zag pattern across the back surface of the shoulder portion.

* * * * *